US012325501B2

(12) United States Patent
Bierer

(10) Patent No.: US 12,325,501 B2
(45) Date of Patent: Jun. 10, 2025

(54) ADAPTIVE TIE BAR ASSEMBLY FOR SECURE ALIGNMENT OF MULTIPLE MARINE ENGINES AT HIGHER SPEED

(71) Applicant: Walter S. Bierer, Ridgeway, SC (US)

(72) Inventor: Walter S. Bierer, Ridgeway, SC (US)

( * ) Notice: Subject to any disclaimer, the term of this patent is extended or adjusted under 35 U.S.C. 154(b) by 489 days.

(21) Appl. No.: 17/747,072

(22) Filed: May 18, 2022

(65) Prior Publication Data

US 2022/0371714 A1 Nov. 24, 2022

Related U.S. Application Data

(60) Provisional application No. 63/189,761, filed on May 18, 2021.

(51) Int. Cl.
*B63H 20/12* (2006.01)
*B63H 20/00* (2006.01)
*B63H 25/04* (2006.01)

(52) U.S. Cl.
CPC ..... *B63H 20/12* (2013.01); *B63H 25/04* (2013.01); *B63H 2020/003* (2013.01)

(58) Field of Classification Search
CPC .. B63H 20/00; B63H 20/12; B63H 2020/005; B63H 2020/006; B63H 2020/003; B63H 25/02; B63H 25/04; B63H 25/20; E05B 47/026
See application file for complete search history.

(56) References Cited

U.S. PATENT DOCUMENTS 1,085,347 A * 1/1914 Leduc ..... E05B 47/0002 292/144
3,756,186 A * 9/1973 Nordling ..... B63H 5/18 440/63
2010/0138083 A1* 6/2010 Kaji ..... B63H 25/02 701/21

OTHER PUBLICATIONS

Mercruiser (Part No. 61359A7, Mercruiser vol. 1 (1986 Thru 1993), https://www.vansoutboardparts.com/mercury-outboard-motor-parts/accessories/exhaust-cooling-systems-and-extension-kits/mercruiser-vol-1-1986-thru-1993/dual-engine-tie-bar-kit/c1-13881?trail=17,9,1134,4568). Accessed Nov. 15, 2024. (Year: 1993).*

* cited by examiner

*Primary Examiner* — Scott A Browne
*Assistant Examiner* — Jisun Choi
(74) *Attorney, Agent, or Firm* — Seth L. Hudson; Maynard Nexsen PC

(57) ABSTRACT

An adaptable tie bar assembly for use with a power boat having more than one engine. The adaptable tie bar assembly comprises a hollow tube for a first part, a rod for second part that slides within the first part of the adaptable tie bar assembly and a pin to secure the rod second part in fixed position in the hollow tube at which point the engines are parallel and the power boat is being operated at higher speeds. A solenoid may be used to insert and retract the pin. Physically aligned and secured engines improve safety when moving at high speeds. At lower speeds, being able to operate the engines independently enables better steering control.

19 Claims, 5 Drawing Sheets

ADAPTIVE TIE BAR ASSEMBLY FOR SECURE ALIGNMENT OF MULTIPLE MARINE ENGINES AT HIGHER SPEED

CROSS REFERENCE TO RELATED PATENT APPLICATION

The present patent application/patent claims the benefit of priority of co-pending U.S. Provisional Patent Application No. 63/189,761 filed on May 18, 2021, and entitled "ADAPTABLE TIE BAR ASSEMBLY FOR SECURE ALIGNMENT OF MULTIPLE MARINE ENGINES AS HIGHER SPEEDS."

BACKGROUND

The present invention relates to marine engine control, and in particular to the control of plural marine engines when used to drive a power boat at higher speeds.

A power boat with a single engine may be controlled with a steering wheel much in the same manner as an automobile is controlled. Two or more marine engines may be used for additional power for a larger power boat and for greater speed. Controlling more than one engine has been accomplished by using a "tie bar".

A tie bar mechanically ties two or more outboard engines together rigidly so that their propulsion directions are aligned, and the engines preserve that alignment when turned to the left and to the right by the same degree of angular displacement in response to the control exercised by the driver of the power boat, thereby assuring the same angular displacement for both the engines moves the boat forward at maximum efficiency.

Finer control, for use in maneuvering the boat in a crowded harbor or near a dock, for example, and particularly in maneuvering into a boat slip when there may be cross-winds and stronger currents, is more difficult with multiple engines joined by tie bars. To accommodate this need for better control while still preserving the capability for unified engine control, computer-based steering controllers have replaced tie bars.

Computer-based control systems typically provide a joy-stick rather than a steering wheel to enable the operator of the power boat to control direction of the boat. A computer processor receives signals from the movement of the joy-stick that it translates into angular positions for the motors that move the power boat. These computer-controlled systems work reasonably well for both maneuvering and forward motion.

For power boats that have more than one motor and are capable of higher speeds—speeds that can be in excess of 130 knots/hour—software and computer-actuated controls work reasonably well, in theory.

SUMMARY OF THE DISCLOSURE

The present disclosure teaches a novel tie bar assembly that provides the operator of a power boat equipped with two or more computer-controlled engines the additional assurance that, at higher speeds, the angular displacement between all the engines stays at a predetermined angle near zero degrees.

The novel tie bar assembly includes a first shaft and a second shaft receivable inside the first shaft. The second shaft slides freely within the first shaft, in the manner of a cylindrical bearing, unless it is restrained from axial movement. Both the first shaft and the second shaft have corresponding transverse holes. The transverse holes comprise a pair of holes through the second shaft and at least one transverse hole in first shaft. The axes of the holes of the first and second shafts can be aligned to receive a pin that prevents further axial movement of first shaft with respect to second shaft as long as the pin is in place.

When first shaft and second shaft are secured together with the pin, the present tie bar assembly operates in the same manner as a traditional tie bar assembly: holding the marine engines in a parallel relationship regardless of their orientation with respect to the axis of the shaft. When the pin is removed, the first shaft and the second shaft are then free to slide axially relative to each other and thus the angle between the engines attached to the tie bar assembly may be changed, with the two engines oriented at different angles with respect to each other, restoring maneuvering control of the marine engines to an onboard computer processing unit, as directed by the boat operator through a joystick.

At a pre-designated speed, however, the pin is inserted to secure the two marine engines in parallel relationship for steering by the boat operator using a steering wheel. Below the pre-designated speed, the pin can be withdrawn and the steering of the boat returns to joy-stick control.

Insertion and withdrawal of the pin may be subject to software or other computer control programming, such as, for example, using speed set points to cause the control system to align the engines so that the holes in the first shaft and second shaft are aligned, and then causing an electronically-activated solenoid to insert the locking pin into the aligned holes automatically based on speed set points. The control system, on reaching a first speed set point on accelerating will activate the electronically-activated solenoid to insert the pin to lock the marine engines in the same relative angle of operation, and on reaching a second preset speed on decelerating, the control system activates the electronically-activated solenoid to withdraw the pin to restore normal joy-stick operation and its greater control of the operation of the individual marine engines.

An aspect of the disclosure is that the locking of the engines in parallel position at higher speeds is a safety feature that helps to prevent loss of control.

An aspect of the present disclosure is that locking of the two-part tie bar assembly may be automatic at a pre-designated speed and therefore provide an additional safety feature that depends only on the speed of the power boat for activation and not on the operator of the boat to activate it.

Another aspect of the present disclosure is that the two-part tie bar assembly adaptively connects to two marine engines in the same manner as prior art tie bars connected to marine engines, namely, by attaching to a yoke rigidly affixed to the rear of each engine and a threaded, lockable adjustment on one yoke to allow an adjustment in the spacing of the two engines so they are oriented in parallel. Once the engines are set in parallel, further adjustments are not required to the present tie-bar. The predrilled holes in the hollow outer shaft and solid inner shaft are formed precisely to accept the pin translates the angle of one engine to a corresponding angle of the other.

These and other aspects of the disclosure will be readily apparent to those skilled in the art of the operation of power boats from a careful reading of the detailed description accompanied by the following drawings.

DETAILED DESCRIPTION

Figure 1:
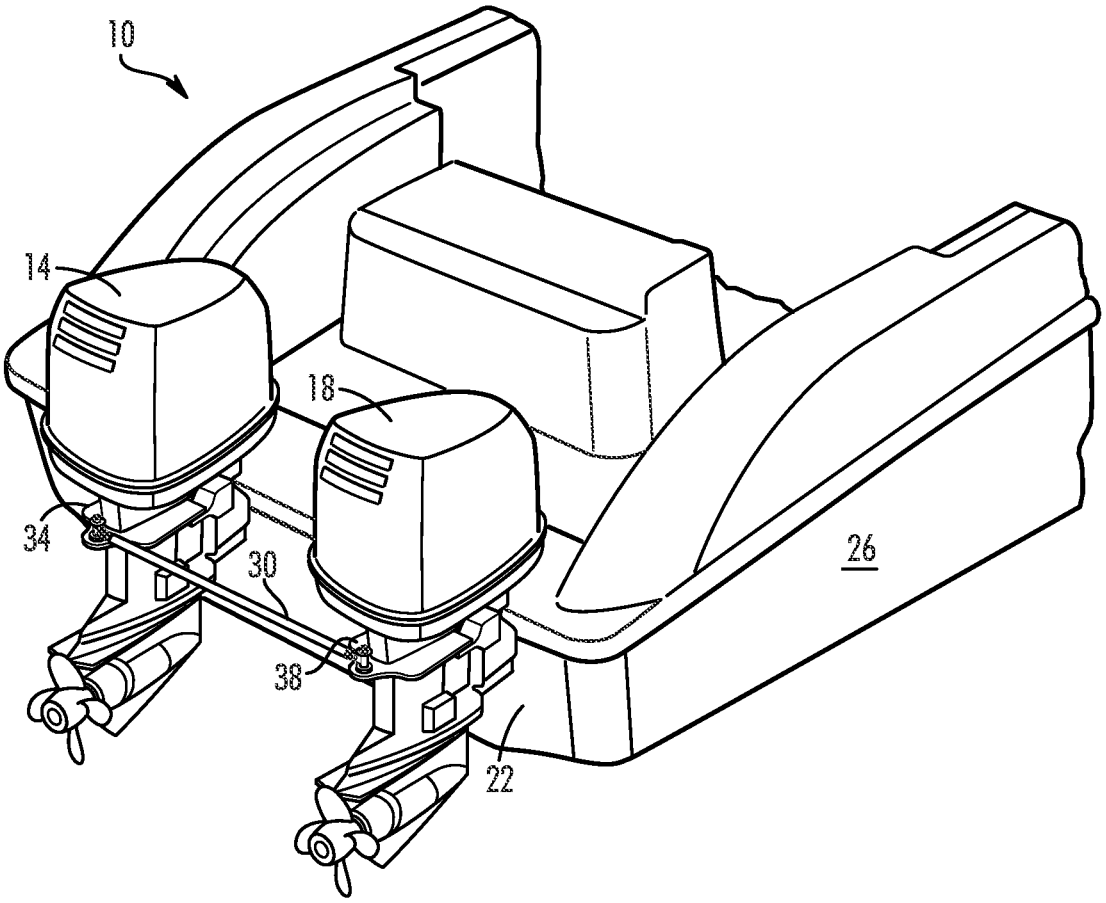
FIG.1 PRIOR ART
FIG. 1 illustrates in perspective a portion of the hull of a power boat with two marine engines held in parallel by a prior art tie bar, according to an aspect of the present disclosure.

The present disclosure teaches an improved tie bar assembly for use with a power boat 10. Referring now to the drawings. FIG. 1 shows a portion of a power boat 10 having a first marine engine 14 and a second marine engine 18 attached to the stern 22 of the hull 26 of power boat 10 for propelling power boat 10 on water, particularly at higher speeds.

Figures 2A, 2B:
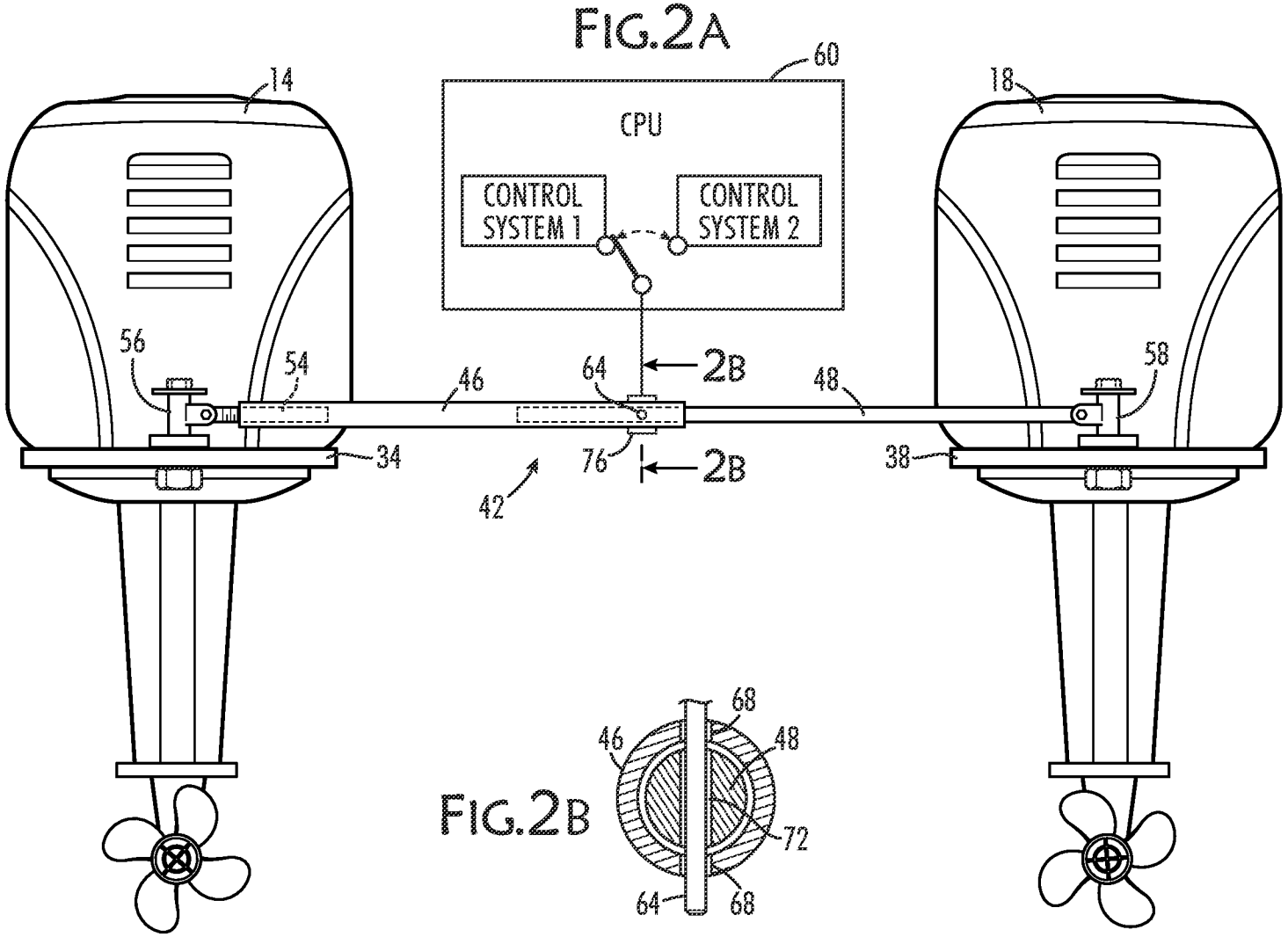
FIG. 2A is a rear view of the power boat of FIG. 1 showing a first marine engine and a second marine engine attached to the present, adaptive, tie bar assembly and a central processing unit, depicted schematically in connection with the aligned holes in hollow first shaft and second shaft, according to an aspect of the present disclosure.
FIG. 2B is a right side view of a detail of FIG. 2A showing, in cross-section, an end view of a pin inserted through holes in an aligned, hollow first shaft and a solid second shaft of the adaptable tie bar assembly, according to an aspect of the present disclosure.
Figure 3A:
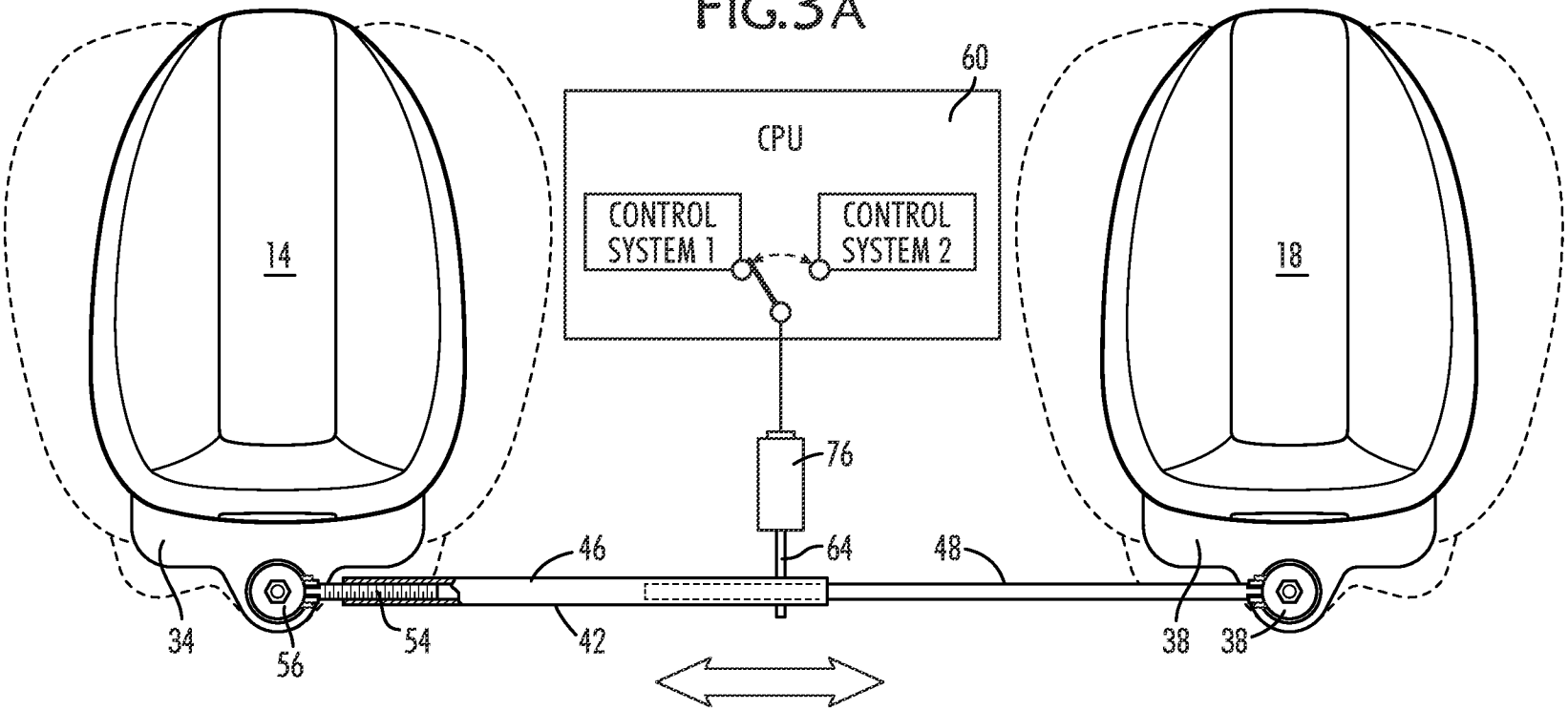
FIG. 3A illustrates a top view of first and second marine engines connected to the present tie bar assembly and with pin inserted by central processing unit for operation according to control system 1, wherein central processing unit maintains the angular alignment of the first engine and the second engine when first and second marine engines change the power boat hull direction, according to an aspect of the disclosure.
Figure 3B:
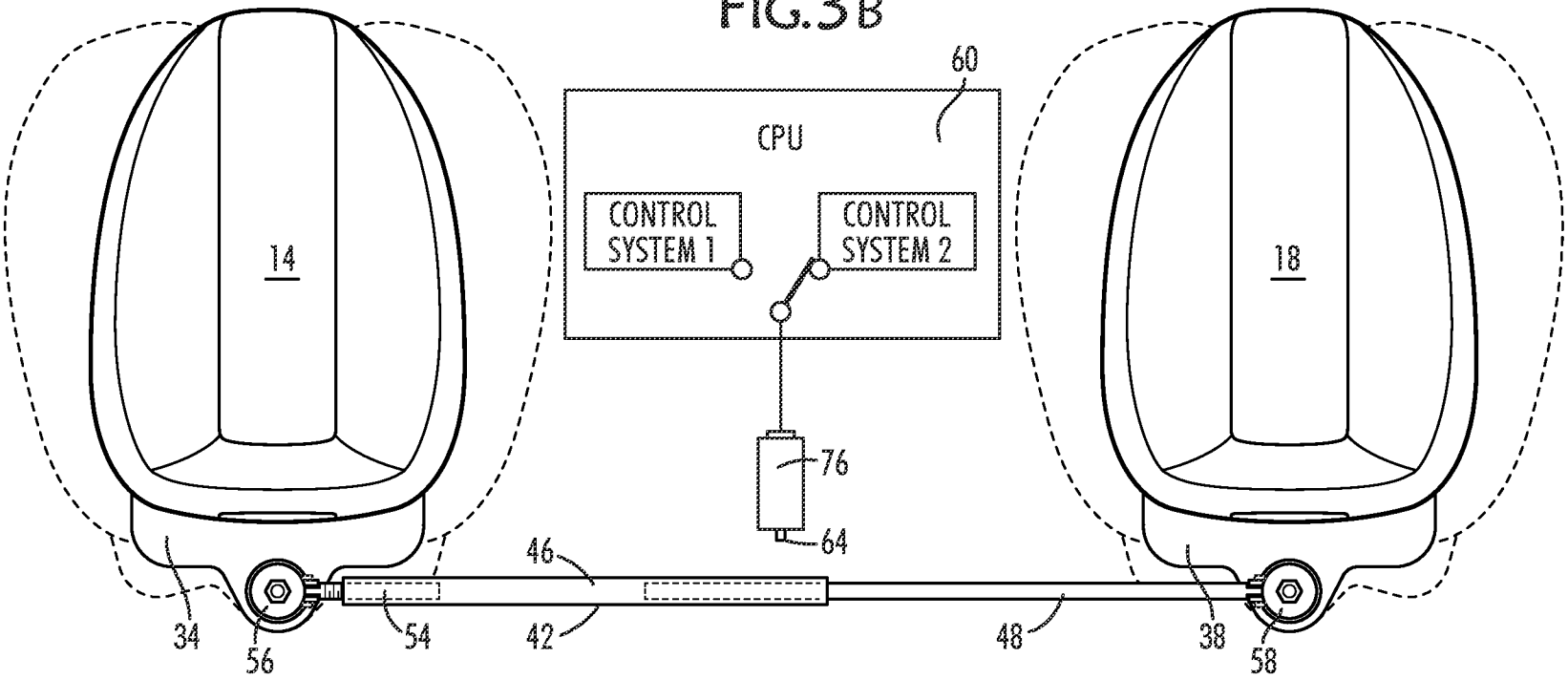
FIG. 3B illustrates a top view of first and second marine engines connected to the present tie bar assembly with pin removed by central processing unit for operation according to control system 2, wherein central processing unit allows a difference in the angular alignment of first engine and second engine thereby enabling the first engine and the second engine to be pivoted independently of each other, according to an aspect of the disclosure.

Also shown in FIG. 1 is a prior art tie bar 30 connected to first marine engine 14 and second marine engine 18. A first end of tie bar 30 is secured to a first yoke 34 on first marine engine 14 via an adjustment fitting 54; an opposing second end of tie bar 30 is attached to a second yoke 38 on second marine engine 18. Prior art tie bar 30 assures that first marine engine 14 and second marine engine 18 remain aligned at all times, and the pivoting of one is matched by a pivot of the other The present adaptable tie bar assembly 42 of the present invention, as shown in FIGS. 2A, 3A, and 3B, holds first marine engine 14 and second marine engine 18 in parallel relationship when power boat 10 is moving forward above a pre-designated speed but also enables independent pivoting of first marine engine 14 and second marine engine 18 with respect to each other at lower speeds and when finer control is needed, such as during close maneuvering in a crowded harbor and parking in a dock area. The power boat 10 utilizing the tie bar assembly 42 will have the same structure as shown in FIG. 1 and described above. Power boat 10 may have more than two marine engines and or two engines that are more powerful. A newer power boat 10 may also be bigger and heavier or lighter and with marine engines capable of higher speeds, including speeds in excess of 100 kph.

Referring now to FIG. 2A, there is illustrated the present, adaptable tie bar assembly 42. Adaptable tie bar assembly 42 includes a first shaft 46 with a first end and a second end and a second shaft 48 with a first end and a second end. The first end of the first shaft 46 is hollow for receiving the first end of the second shaft 48. As illustrated in FIGS. 2A, 3A, and 3B, the first end of the second shaft 48 is received within the hollow portion of the first end of the first shaft 46, resulting in a portion of the second shaft 48 inside first shaft 46. The first shaft 46 may be hollow, partially hollow, and/or contain a hollow portion on the first end and the second end. At least the first end of the first shaft 46 may be hollow for receiving the first end of the second shaft 48. As illustrated, the hollow portion of the first shaft 46 has a circular cross-section and the first end of the second shaft 48 also has a circular cross-section. The diameter of the first end of the second shaft 48 is smaller than the diameter of the hollow portion of the first shaft 46, allowing the first end of the second shaft 48 to be received within the hollow portion of the first end of the first shaft 46. While a circular cross-section has been illustrated and described herein, the cross-section may be other shapes, such oval, square, rectangular, triangular, and the like. Furthermore, the cross-section of the first shaft 46 and the second shaft 48 may be circular, oval, square, rectangular, triangular, and the like. The second end of the first shaft 46 may terminate in an adjustment fitting 54. The adjustment fitting 54 is attached to a first connector device 56, which is attached to the first yoke 34 of the first engine 14. The second end of the second shaft 48 is attached to a second connector device 58, which is attached to the second yoke 38 of the second engine 18. The adjustment fitting 54 enables the adaptable tie bar assembly 42 to hold the first marine engine 14 and the second marine engine in parallel.

The adjustment fitting 54 contains a first end and a second end. The first end is received within the second end of the first shaft 46 and the second end is engaged to the first connector device 56. As mentioned above, the first shaft 46 may be hollow, partially hollow, or contain a hollow portion on the first end and/or the second end. The second end of the first shaft 46 at least contains a hollow portion for receiving the first end of the adjustment fitting 54. The adjustment fitting 54 may be circular and the hollow portion of the second end of the first shaft 46 that receives the first end of the adjustment fitting 54 may also be circular, wherein the diameter of the adjustment fitting 54 or at least the portion of the adjustment fitting 54 received within the second end of the first shaft 46 has a diameter slightly smaller than the inside diameter of the hollow portion of the second end of the first shaft 46. The first end of the adjustment fitting 54 is externally threaded and the second end of the first shaft 46 is internally threaded for mating the adjustment fitting 54 to the first shaft 46 in a selectively secured arrangement, allowing the adjustment fitting 54 to be separated from the first shaft in a manner that does not damage the adjustment fitting 54 or first shaft 46. The adjustment fitting 54 is rotated within the hollow portion of the second end of the first shaft 46, translating along the longitudinal axis of the first shaft 46. In other words, the adjustment fitting 54 is rotated and moves within the hollow portion of the second end of the first shaft 46. The adjustment fitting 54 allows the adaptable tie bar assembly 42 to be adjustable and maintain a length as desired by the user for the particular operation. While a circular cross-section has been illustrated and described herein for the adjustment fitting 54 and the hollow portion of the second end of the first shaft 46, the cross-section may be other shapes, such oval, square, rectangular, triangular, and the like.

The first shaft 46 contains a transverse hole 68 extending through the first shaft from one side of the first shaft 46 to the opposite side of the first shaft 46. The transverse hole 68 is preferably disposed on the first end of the first shaft 46. As illustrated in FIG. 2B, the transverse hole 68 extends from the outer surface of one side of the first shaft 46 to the interior surface of the first shaft 46, and from the outer surface of an opposite side of the first shaft 46 to the interior surface of the first shaft 46. A pin 64 may be inserted through the transverse hole 68. The second shaft 48 contains a corresponding hole 72 extending through the second shaft 48 from one side of the second shaft 48 to the opposite side of the second shaft 48. The corresponding hole 72 is preferably disposed on the first end of the second shaft 48. As illustrated in FIG. 2B, the corresponding hole 72 extends from the outer surface of one side of the second shaft 48, through the second shaft 48, to the outer surface of the opposite side of the second shaft 48. The first shaft 46 may contain two or more transverse holes 68 or a plurality of transverse holes 68. Likewise, the second shaft 48 may contain two or more corresponding holes 72 or a plurality of corresponding holes 72. The pin 64 is operationally coupled to the electrically-activated solenoid 76, meaning the electrically-activated solenoid 76 controls the movement of the pin 64, allowing the pin 64 to be inserted into the transverse hole 68 and corresponding hole 72 and removed or withdrawn from the transverse hole 68 and corresponding hole 72.

Figure 4:
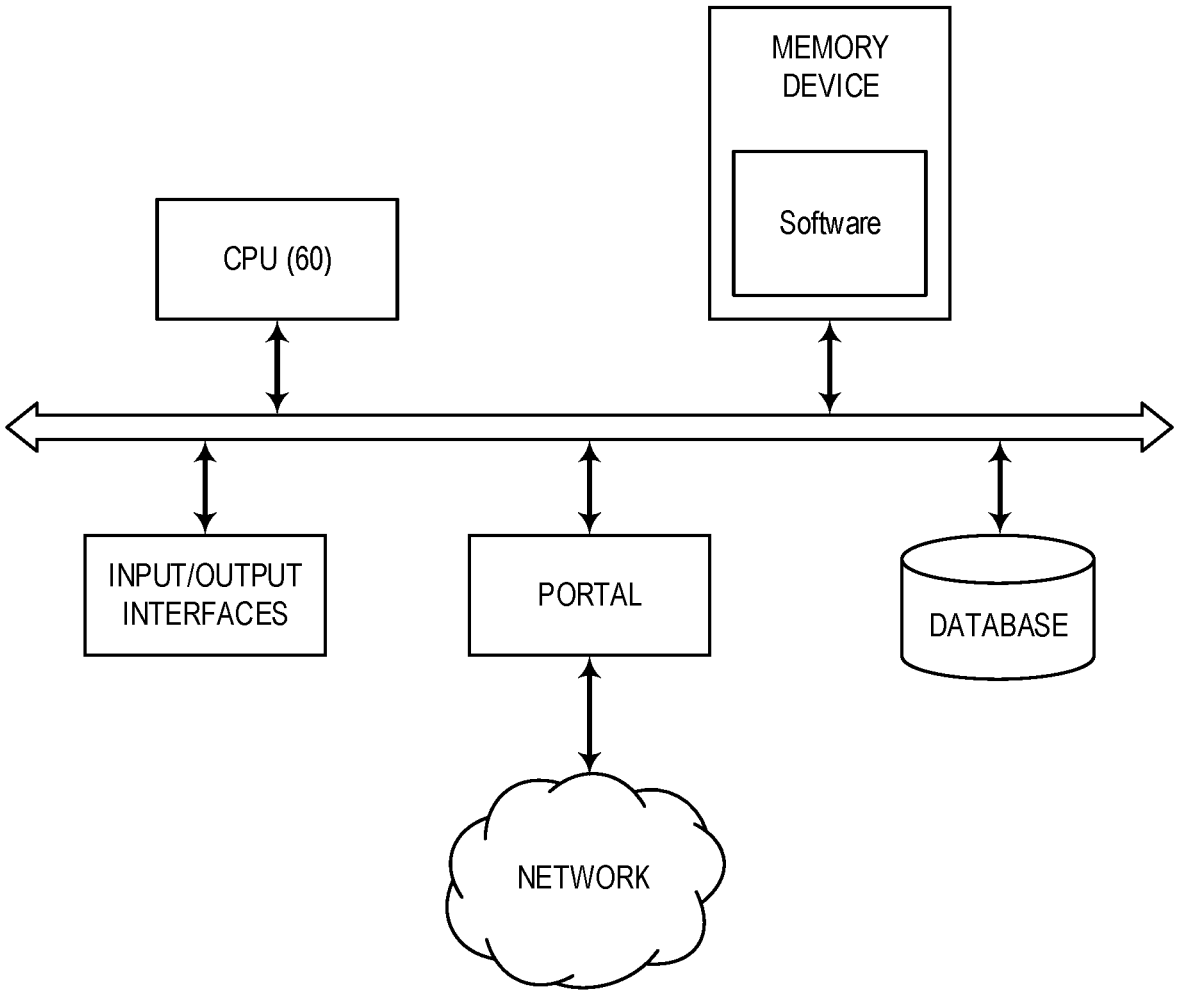
FIG. 4 is a block diagram of an example embodiment of the system as described herein.

The adaptable tie bar assembly 42 may be coupled to a processing device, such as a central processing unit (CPU) 60. The CPU 60 may be part of a digital computer that, in terms of hardware architecture, generally includes a memory device, input/output (I/O) interfaces, and a network interface. The memory device may include a data store, database, or the like. It should be appreciated by those of ordinary skill in the art that FIG. 4 depicts the system, containing the CPU 60 that allows the switching between control systems and alignment of the marine engines (14, 18) in a simplified manner, where practical embodiments may include additional components and suitably configured processing logic to support known or conventional operating features that are not described in detail herein. An electrically-activated solenoid 76 is communicatively coupled via a local interface. The local interface may be, for example, but not limited to, one or more buses or other wired or wireless connections. The local interface may have additional elements, which are omitted for simplicity, such as controllers, buffers, caches, drivers, repeaters, receivers, among other elements, to enable communications. Further, the local interface may include address, control, and/or data connections to enable appropriate communications with the electrically-activated solenoid 76.

The CPU 60 is a hardware device adapted for at least executing software instructions. When a power boat 10 is in operation, the CPU 60 may be configured to execute software stored within the memory device, to communicate data to and from the memory device, and to generally control positioning of the first marine engine 14 and the second marine engine 18 and activating the electrically-activated solenoid 76 pursuant to the software instructions based upon feedback from one or more sensors, including one or more speed sensors.

The I/O interfaces may be used to receive user input from and/or for providing system output to one or more devices or components. User input may be provided via, for example, a keyboard, touchpad, a mouse, and/or other input receiving devices. The system output may be provided via a display device, monitor, graphical user interface (GUI), a printer, and/or other user output devices. I/O interfaces may include, for example, a serial port, a parallel port, a small computer system interface (SCSI), a serial ATA (SATA), a fiber channel, InfiniBand, iSCSI, a PCI Express interface (PCI-x), an infrared (IR) interface, a radio frequency (RF) interface, and/or a universal serial bus (USB) interface. At least one sensor is communicatively coupled to the I/O interface. The sensor(s) determine the speed of the power boat 10. Speed can be determined by GPS tracking and/or detecting speed relative to water.

The network interface may be used to enable communication over a network, such as the network, the Internet, a wide area network (WAN), a local area network (LAN), and the like. The network interface may include, for example, an Ethernet card or adapter (e.g., 10BaseT, Fast Ethernet, Gigabit Ethernet, 10 GbE) or a wireless local area network (WLAN) card or adapter (e.g., 802.11a/b/g/n/ac). The network interface may include address, control, and/or data connections to enable appropriate communications on the network. A NMEA 2000 interface is preferably utilized that allows various devices using Controller Area Network (CAN) technology on the power boat to communicate with each other within the same network without interference. The NMEA 2000 standard contains the requirements of a serial data communications network to inter-connect marine electronic equipment on vessels. The standard describes a low-cost moderate capacity bi-directional, multi-transmitter/multi-receiver instrument network to interconnect marine electronic devices. It is multi-master and self-configuring, and there is no central network controller. Equipment designed to this standard will have the ability to share data, including commands and status with other compatible equipment over a single channel. It is based on CAN (Controller Area Network).

The memory device may include volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the memory device may incorporate electronic, magnetic, optical, and/or other types of storage media. The memory device may have a distributed architecture, where various components are situated remotely from one another, but can be accessed by the CPU 60. The software in memory device may include one or more software programs, each of which may include an ordered listing of executable instructions for implementing logical functions. The software in the memory device may also include a suitable operating system (O/S) and one or more computer programs. The operating system (O/S) essentially controls the execution of any other computer programs, and can provide timing, input-output control, file and data management, and memory management. The computer programs may be configured to implement the various processes, algorithms, methods, techniques, etc. described herein.

The memory device may include a data store used to store data. Moreover, some embodiments may include a non-transitory computer-readable storage medium having computer readable code stored in the memory device or other processor-equipped computer, server, appliance, device, circuit, etc., to perform functions as described herein.

Examples of such non-transitory computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer-readable medium, software can include instructions executable by the CPU 60 that, in response to such execution, cause the CPU 60 to perform a set of operations, steps, methods, processes, algorithms, functions, techniques, etc. as described herein for the various embodiments.

As shown, the memory device may include software that interprets the sensor data received from the sensor and based upon the sensor data the software sends instructions to the CPU 60 to perform a set of operations, such as switching between control systems. FIG. 2A shows, schematically, a CPU 60 that includes two control systems: control system 1 and control system 2. CPU 60 can switch between control system 1 and control system 2 and back to control system 1 based on, for example, the speed of power boat 10 as determined by the sensor. Switching between control system 1 and control system 2 may involve, as best seen in FIG. 2B, activating the electronically-activated solenoid 76 for the removal of pin 64 from the transverse hole 68 in the first shaft 46 and a corresponding hole 72 in the second shaft 48, enabling the first shaft 46 and the second shaft 48 to slide freely relative to each other and thereby enable first marine engine 14 and second marine engine 18 to depart from a parallel relationship and permit finer control of power boat 26, for example, in parking boat 26 in a boat slip.

When pin 64 is in transverse hole 68 and corresponding hole 72, as seen in FIGS. 2B and 3A, the adaptable tie bar assembly 42 maintains the first marine engine 14 and the second marine engine 18 in parallel alignment. First marine engine 14 and second marine engine 18 may be steered to the left or the right (as indicated by the dashed lines on both sides of both engines, but will always be parallel with respect to each other). When pin 64 is not in transverse hole 68 and corresponding hole 72, as seen in FIG. 3B, the second shaft 48 may slide axially with respect to hollow first shaft 46, so that first marine engine 14 and second marine engine 18 may then depart from a parallel orientation with respect to each other and be pivoted to different angles within a range, which range is indicated by the dashed lines surrounding first marine engine 14 and second marine engine 18.

Based upon instructions received, the CPU 60 switches between control system 1 and control system 2 based on the speed of hull 26 and sensor data input from the sensor. When accelerating past a preset speed 50 kph, for example, CPU 60 may switch from control system 1 to control system 2 where first marine engine 14 and second marine engine 18 are locked in a parallel relationship. Boat 26 can be steered but first marine engine 14 and second marine engine 18 are always parallel in control system 2. On decelerating to a preset speed of 20 kph, for example, CPU 60 may be programmed to switch from control system 2 back to control system 1 and thus enable adaptable tie bar assembly 42 to allow more independent control of marine engine 14 and marine engine 18 for greater maneuverability.

In control system 1, as seen in FIGS. 2A and 2B, first marine engine 14 and second engine 18 are aligned by CPU 60 so that hollow first shaft 46 of adaptable tie bar assembly 42 and second shaft 48 align a transverse hole 68 in hollow first shaft 46 with a corresponding hole 72 in second shaft 48. When transverse hole 68 and corresponding hole 72 are aligned, the electrically-activated solenoid 76 is activated, inserting the pin 64 to lock first hollow first shaft 46 and second shaft 48 together to hold first marine engine 14 and second marine engine 18 parallel to each other. CPU 60 can be programmed to switch to control system 2 automatically when the speed of hull drops below a pre-selected speed, such as 20 kph. CPU 60 may also be programmed to switch from control system 2 to control system 1 at the same pre-determined speeds, one reached on deceleration and the other on acceleration through a predetermined speed. The predetermined speed for switching between control system 1 and control system 2 may by input by a user through an input interface or preprogrammed within the software program.

Alternatively, pin 64 may be inserted by hand.

The foregoing description and the accompanying figures are intended to explain the present invention using embodiments that are of necessity limited in scope but still illustrate for those of ordinary skill the general concepts of the present disclosure.

What is claimed is:

1. An adaptive tie bar assembly, comprising:

a first shaft with a transverse hole formed therein, the first shaft has a first end and a second end;

a second shaft having a corresponding hole, the second shaft being insertable in the first shaft and slidable therein to enable alignment of the corresponding hole with the transverse hole;

a first connector device on the second end of the first shaft, the first connector device attachable to a yoke on a first engine of a boat;

a second connector device on the second end of the second shaft, the second connector device attachable to a yoke on a second engine of a boat; and a solenoid operable to respond to a control system, the solenoid having a pin dimensioned to fit through the transverse hole and the corresponding hole when the transverse hole and the corresponding hole are aligned, wherein the solenoid moves between a first position and a second positon based on a speed of a power boat, wherein in the pin engages the transverse hole and the corresponding hole in the first position and the pin is disengaged from the transverse hole and the corresponding hole in the second position.

2. The adaptive tie bar assembly of claim 1, wherein said solenoid is electrically actuated by the control system.

3. The adaptive tie bar assembly of claim 1, wherein the solenoid is actuated automatically on accelerating a power boat above a pre-designated speed.

4. The adaptive tie bar assembly of claim 1, wherein said solenoid is deactivated automatically on slowing below a pre-designated speed.

5. The adaptive tie bar assembly of claim 1, wherein the first shaft has a circular, oval, triangular, square, or rectangular cross-section.

6. The adaptive tie bar assembly of claim 1, wherein the second shaft has a circular, oval, triangular, square, or rectangular cross-section.

7. An adaptive tie bar assembly, comprising:

a first shaft with a transverse hole formed therein, the first shaft has a first end and a second end;

a second shaft having a corresponding hole, the second shaft being insertable in the first shaft and slidable therein to enable alignment of the corresponding hole with the transverse hole;

an adjustment fitting engaged to the second end of the first shaft, wherein the adjustment fitting is externally threaded and the second end of the first shaft contains corresponding internal threads;

a first connector device on the second end of the first shaft, the first connector device attachable to a yoke on a first engine of a boat; and a second connector device on the second end of the second shaft, the second fitting attachable to a yoke on a second engine of a boat; and a solenoid operable to respond to a control system, the solenoid having a pin dimensioned to fit through the transverse hole and the corresponding hole when the transverse hole and the corresponding hole are aligned, wherein the solenoid moves between a first position and a second positon based on a speed of a power boat, wherein in the pin engages the transverse hole and the corresponding hole in the first position and the pin is disengaged from the transverse hole and the corresponding hole in the second position.

8. The adaptive tie bar assembly of claim 7, wherein said solenoid is electrically actuated by the control system.

9. The adaptive tie bar assembly of claim 7, wherein the solenoid is actuated automatically on accelerating a power boat above a pre-designated speed.

10. The adaptive tie bar assembly of claim 7, wherein said solenoid is deactivated automatically on slowing below a pre-designated speed.

11. The adaptive tie bar assembly of claim 7, wherein the first shaft has a circular, oval, triangular, square, or rectangular cross-section.

12. The adaptive tie bar assembly of claim 7, wherein the second shaft has a circular, oval, triangular, square, or rectangular cross-section.

13. An adaptive tie bar assembly for use on a power boat, the power boat comprises:

a hull;

a control system;

a first engine having a first yoke;

a second engine having a second yoke, the control system controlling the first engine and the second engine so that the hull is moved at a speed and a direction; the tie bar assembly is connected to the first yoke of the first engine and to the second yoke of the second engine; and the tie bar assembly comprises:

a first shaft with a transverse hole formed therein, the first shaft has a first end and a second end;

a second shaft having a corresponding hole, the second shaft being insertable in the first shaft and freely slidable therein to enable alignment of the corresponding hole with the transverse hole, wherein a pin is insertable into the transverse hole and the corresponding hole to fix the first shaft relative to the second shaft, wherein each of the first engine and the second engine are controllable by the control system in an instance in which the pin is disengaged with the transverse hole and the corresponding hole;

a first connector device on the second end of the first shaft, the first connector device attachable to the first yoke; and a second attachable device on the second end of the second shaft, the second attachable device attachable to the second yoke.

14. The adaptive tie bar assembly according to claim 13 further comprising a solenoid operable to respond to the control system, the solenoid having a pin dimensioned to fit through the transverse hole and the corresponding hole when the transverse hole and the corresponding hole are aligned.

15. The adaptive tie bar assembly according to claim 1, wherein each of the first engine and the second engine are controllable by the control system in an instance in which the pin is disengaged with the transverse hole and the corresponding hole.

16. The adaptive tie bar assembly according to claim 7, wherein each of the first engine and the second engine are controllable by the control system in an instance in which the pin is disengaged with the transverse hole and the corresponding hole.

17. The adaptive tie bar assembly according to claim 1, wherein a length from the first end of the first shaft to a second end of the first shaft is straight, and wherein a length from a first end of the second shaft to a second end of the second shaft is straight.

18. The adaptive tie bar assembly according to claim 7, wherein a length from the first end of the first shaft to a second end of the first shaft is straight, and wherein a length from a first end of the second shaft to a second end of the second shaft is straight.

19. The adaptive tie bar assembly according to claim 13, wherein a length from the first end of the first shaft to a second end of the first shaft is straight, and wherein a length from a first end of the second shaft to a second end of the second shaft is straight.

* * * * *